United States Patent [19]

Ortlinghaus

[11] Patent Number: 4,529,373

[45] Date of Patent: Jul. 16, 1985

[54] BURNER SAFETY IGNITION SYSTEM ALLOWING FOR ELECTRICAL AND MANUAL OPERATION

[75] Inventor: Ulrich Ortlinghaus, Remscheid, Fed. Rep. of Germany

[73] Assignee: Joh. Vaillant GmbH & Co., Remscheid, Fed. Rep. of Germany

[21] Appl. No.: 400,922

[22] Filed: Jul. 22, 1982

[51] Int. Cl.[3] ..... F23Q 9/08

[52] U.S. Cl. ..... 431/6; 431/45; 431/53; 431/59

[58] Field of Search ..... 431/43, 45, 46, 53–56, 431/59, 6

[56] References Cited

U.S. PATENT DOCUMENTS

| | | | |
|---|---|---|---|
| 2,411,230 | 11/1946 | Ray | 431/46 |
| 2,501,850 | 3/1950 | Kunzler | 431/54 |
| 2,516,504 | 7/1950 | Cerny et al. | 431/46 |
| 4,318,687 | 3/1982 | Inoue | 431/59 |

*Primary Examiner*—Carroll B. Dority, Jr.
*Attorney, Agent, or Firm*—Horst M. Kasper

[57] ABSTRACT

A system is provided for igniting and monitoring a fuel burning heat source which comprises a thermoelectric safety burner valve, a thermocouple to be heated by a pilot burner, a fuel source feeding fuel to a pilot feed valve and to a main burner feed valve, which in turn are connected to the pilot burner and respectively the main burner. An electric supply source is provided for energizing either an ignition voltage generator or a thermostat simulator. The igniting and monitoring system can be operated electrically or otherwise manually regardless of the state of the electric supply source. A manually operable pilot fuel valve is connected in parallel to the electrically actuated pilot fuel valve and is connected with a switch for disconnecting the electric supply voltage. Thus the heat source can be operated manually in cases where the electrical supply source is not available without impairing the generation of heat.

29 Claims, 2 Drawing Figures

BURNER SAFETY IGNITION SYSTEM ALLOWING FOR ELECTRICAL AND MANUAL OPERATION

BACKGROUND OF THE INVENTION

1. Field of the Invention

The present invention relates to an ignition and monitoring provision for burners of fluid fuels which have a manually operable thermoelectric ignition safety provision with a thermoelectric element heated by a pilot burner fed from a pilot feed valve as well as a main feed valve for the main burner.

2. Brief Description of the Background of the Invention Including Prior Art

Igniting and monitoring devices, which are provided as pure thermoelectrical ingition safety devices, are known for fuel burning heat sources and in particular gas heated water heaters, which may or may not be operating with an electric supply. In the context of such heat sources it is assumed that independent of the presence of the electric supply the pilot light burns continuously during the off-times of the main burner.

SUMMARY OF THE INVENTION

1. Purposes of the Invention

It is an object of the invention to provide an ignition and monitoring provision with support of an electric supply voltage, which if desired or necessary can be actuated manually independent from the operation of the electric supply.

It is another object of the present invention to provide an ignition system for fluid fuel fed burners, which can be operated even upon a failure of the electric supply system.

It is a further object of the present invention to provide a method for igniting a burner either manually or electrically as desired, where the electrical supply source is disconnected from the electrical burner ignition system upon beginning of manual operation.

These and other objects and advantages of the present invention will become evident from the description which follows.

2. Brief Description of the Invention

The present invention provides a burner safety ignition system for a fluid fuel using burner, which comprises a feed line for the fluid fuel, a pilot feed valve for controlling the flow of fluid fuel to a pilot burner and piped to the feed line, a pilot burner piped to the pilot feed valve, a main burner valve for controlling the flow of fluid fuel to the main burner and piped to the feed line, a main burner piped to the main burner valve, an electric ignition system for the burner connected to an electric supply source, a handle member for manually operating a pilot feed valve, a switch actuated by the handle member for disconnecting the electric supply source from the electric ignition system upon actuation of the handle member, and an electrical actuator for operating a pilot feed valve.

An ignition generator can be provided connectable to the electric supply source. A thermoelectric current simulation member can be connectable to the electric supply source. A dual parallel feed can be provided for the pilot burner including a pilot feed valve in each branch, where one pilot feed valve is manually operable and where the second feed valve is operated by an electrical actuator. Alternatively, the handle member and the electrical actuator for operating a pilot feed valve can be associated with one single pilot feed valve disposed in the line connecting fluid fuel source and pilot burner. Preferably the handle is lockable in a position corresponding to an open pilot feed valve.

A normally open contact of a thermoelectric safety relay and a changeover switch actuated by a thermal sensor switch can be disposed in series with the switch actuated by the handle member. A time delay member can be connected to an ignition device for igniting the burner and/or pilot and a changeover switch can be disposed in series with the switch actuated by the handle and connected via a line to the time delay member and to the electrically operated pilot feed valve provided as a magnet valve. A second line connection of the changeover switch can run to the time delay member and to a second changeover switch, which is connected via a line to a thermoelectric current simulation member. The second changeover switch can follow to a switch of the time delay member and the second changeover switch connects in one position to the thermoelectric current simulation member and in the other position the ignition device to the electric supply source.

There is also provided a method for manually or electrically igniting a burner which comprises feeding a fluid fuel to a pilot feed valve from a fuel source, controlling the flow of fluid fuel to a pilot burner by actuating a pilot feed valve, feeding fluid fuel from the pilot feed valve to the pilot burner, feeding fluid fuel from a fuel source to a main burner valve, controlling the flow of fuel to a main burner by actuating the main burner valve, feeding the fuel from the main burner valve to the main burner, energizing an electric ignition system for the burner with electric power, at times electrically actuating a pilot feed valve, at other times manually actuating a pilot feed valve by way of a handle member, and disconnecting the electric supply source from the electric burner ignition system upon manual actuation of the corresponding pilot feed valve.

The manually actuated pilot feed valve and the electrically actuated pilot feed valve can be disposed separately in two parallel running fluid fuel feed pipes connected to the pilot burner. Alternatively, a single pilot feed valve can be provided capable of being actuated both manually and electrically. A thermoelectric current can be simulated to an ignition safety valve. The handle member can be lockable to a position corresponding to an open pilot feed valve.

A changeover switch disposed in series with a contact of the pilot feed valve and the work contact of a normally open thermoelectric safety valve can be actuated by way of a thermal demand sensor. A contact of the changeover switch can be connected via a line, which runs to the pilot feed valve as well as via a time delay member to an ignition device. The other contact of the changeover switch can be connected via a line which runs to the time delay member as well as to a second changeover switch, which is connected via a line to a thermoelectric current simulation member. A switch of the time delay member can be followed by the second changeover switch, which switches in one position the thermoelectric current simulation member and in the other position connects the ignition device to the electric supply voltage.

The invention provides advantages over the state of the art by allowing the user of the heat source to employ the same even upon interruption of the electric power, while an interference with the use in the presence of an electric supply source is not present. This is an important consideration in areas such as the central part of the United States, where again and again ice storms lead to a weight loading of the electric power lines causing ruptures which result in interruption of electric power during the generally worst part of the winter and where in the past with a loss of electricity thus a loss of the conventional electrically operated burner system occured at the time of a power failure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown two of the various possible embodiments of the present invention.

The same reference numerals in the two figures refer to the same type of unit.

DESCRIPTION OF INVENTION AND PREFERRED EMBODIMENTS

Figure 1:
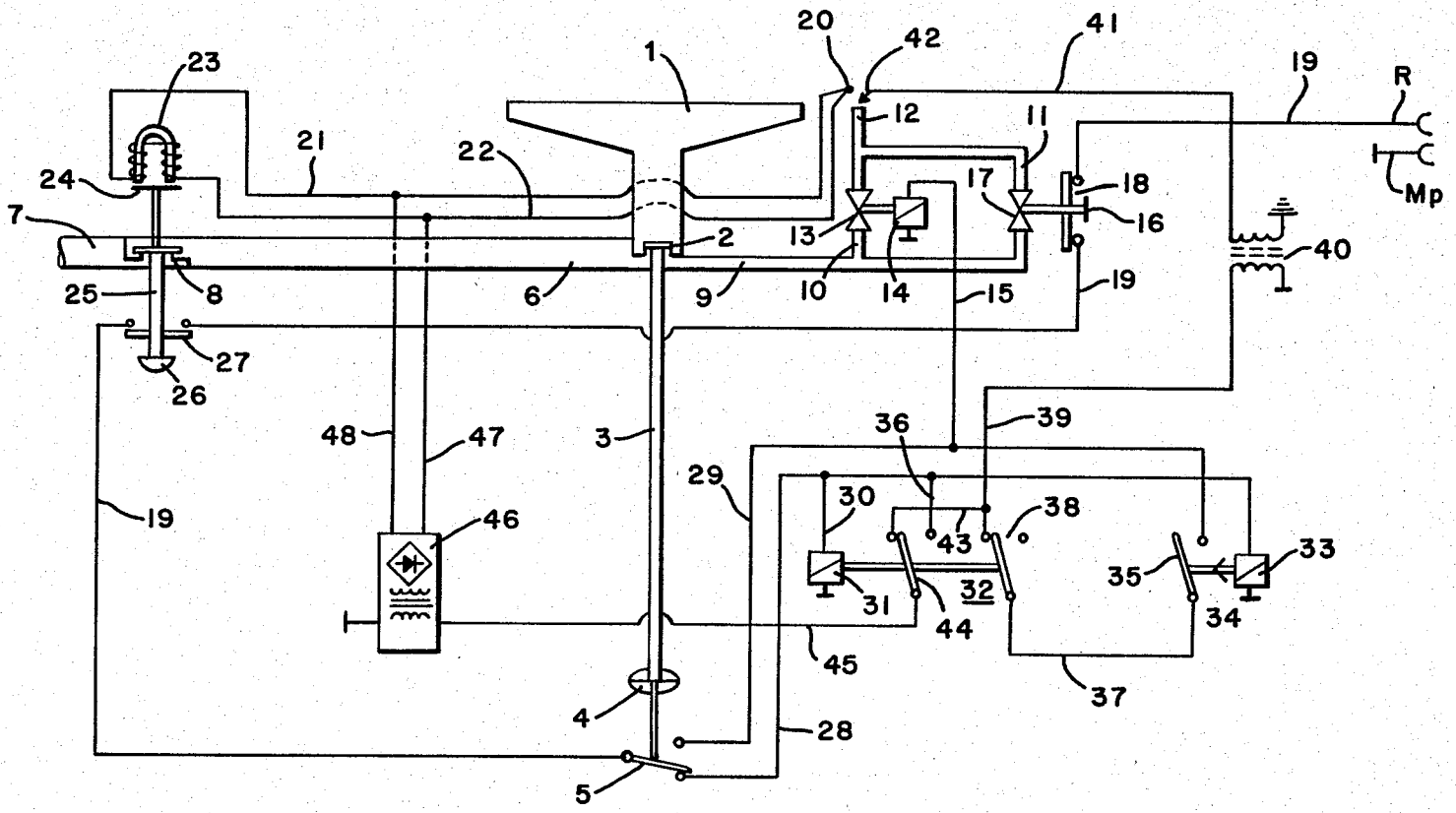
FIG. 1 is a view of a schematic diagram showing an ignition and monitoring provision for a burner.

In accordance with the present invention there is provide an ignition and monitoring system for a fuel burning heat source with a manually operable thermoelectric safety provision, which comprises a thermoelement heated by a pilot burner fed from a pilot burner feed valve and a main burner feed valve piped to the main burner, an electric supply connected to an ignition generator and to a thermoelectric current simulating member. The pilot feed valve 13 is connected in parallel with a manually operable pilot feed valve 17, which is provided with a contact 18 suitable for separating the electric supply source R, Mp. The pilot feed valve 13 can be provided with a handle member 16 (FIG. 2), which can lock the valve in an open state, and where a contact 18 is coupled to the pilot feed valve, which separates off the electric supply source R, Mp.

The contact 18 of the pilot feed valve 13 can be disposed in series connection with a normally open contact 27 of a thermoelectric ignition safety relay 23, 24 and with a changeover switch 5, which is actuated by a heat demanding sensor switch device 4. A contact of the changeover switch 5 can be connected to a line 29, which leads to the pilot feed valve 13 as well as via a time member 33, 34 to an ignition device 40. The other contact of the changeover switch 5 is connected via a line 28, which leads to the time delay member and to a second changeover switch 44, which is connected via a line 45 to a thermoelectric current simulating member 46. The switch 35 of the time delay member 33 is disposed in series with the the switching contact 38. The second changeover switch 44 in the one position connects the thermoelectric current simulating member 46 and in the other position the ignition device to the electric supply voltage.

A fuel burning heat source which is not shown in more detail and may comprise for example a gas or an oil burning boiler or closed circuit or open circuit water heater includes a main burner 1, which is controlled by a main fuel valve 2. The latter has an actuating rod 3, which is actuated by a heat demanding sensor switch device 4, which is controlled by a heat consuming load connected to the heat source. The heat demanding sensor switch device may consist of a room thermostat, that is a switch that is controlled by a room temperature sensor, or by a water flow switch, which is actuated by flowing water when the tapping of the water from an open fluid circuit has been initiated or when a pump incorporated in a closed fluid circuit has been started. The rod 3 is provided with an extension leading to a changeover switch 5.

The main fuel valve 2 is incorporated in a fuel conduit 6, which adjacent to the fuel inlet 7 of the heat source is controlled by a burner safety valve 8. A pilot fuel conduit 9 extends from the fuel conduit 6 and is continued by two branch conduits 10 and 11, both of which are connected to a pilot burner 12. The pilot fuel branch conduit 10 incorporates a solenoid valve 13, which is operable by a solenoid coil 14, to which a voltage can be applied via line 15. The solenoid valve 13 is closed when no voltage is applied to the solenoid coil 14. The conduit 1 incorporates a hand operable valve 17, which is operable by means of a control handle 16. A normally closed switch 18 is associated with the handle operated valve 17 or the handle 16 and is connected in a line 19, which leads to one terminal R of an electric supply source having another terminal Mp.

A thermocouple 20 is associated with the main burner 1 and the pilot burner 12 and is connected by lines 21 and 22 to a solenoid 23 of the thermoelectric burner safety device. The thermoelectric safety device also comprises an armature 24, which is connected to an actuating rod 25, to which also the valve member of the valve 8 is connected. A control handle 26 and a normally closed switch 27 is connected to the rod and is provided in the line 19 in series with the normally closed switch 18. As usual, the burner safety valve 8 is biased to a closed position, so that the valve 8 will be closed when the heat source is off. The pilot valve 17 may be open or closed when the main burner is off.

The line 19 is continued from the switch 27 to the changeover switch 5, which has two contact points, one of which is connected to a line 28 when the main fuel valve is closed and the other of which is connected to another line 29 when the main fuel burner valve is open. The line 28 is connected via a line 30 to coil 31 of a relay 32, which has two changeover switches 38 and 44, and to a coil 33 of a delayed relay 34, which has a normally open switch 35. Another line 36 connects the line 28 to the normally open contact of one changeover switch 44 of the relay 32. The movable contact of the normally open switch 35 is connected by line 37 to the movable contact of the changeover switch 38 of the relay 32. When the coil 31 of the relay 32 is deenergized, lead 37 is connected via the changeover switch 38 to a line 39, which is connected to the primary side of an ignition transformer 40. The secondary side of the ignition transformer is connected by a line 41 to an igniting electrode 42, which is associated with the pilot burner 12. A line 43 branches from the line 39 and is connected to the changeover switch 44 of the relay 32. When the relay 32 is de-energized, the line 43 is connected to a line 45, which is connected to a thermoelectric current simulator 46. The latter is connected by two lines 47 and 48 to the burner safety device. Specifically, line 47 is connected to line 22 and line 48 is connected to line 21.

The other terminal Mp of the electric supply source is grounded, therefore the solenoid coil 14 of the valve 13 incorporated in the pilot fuel feed, the thermoelectric current simulator 46, the relay coils 31 and 33 and the igniting transformer are also grounded at one terminal.

The circuit just described operates as follows: In the position of rest shown on the drawing, i.e., when the system is de-energized, the normally closed switch 18 is closed and the normally open switch 27 of the burner safety device is open so that the electric supply source is disconnected from the changeover switch 5. All relays are de-energized. The main fuel valve 2 and both pilot gas valves 13, 17 are closed. When the control handle 16 is operated in this condition of the system, the pilot gas valve 17 opens but the opening of that valve remains ineffective because the burner safety valve 8 is still closed.

When the heat demanding sensor switch device 4 is actuated based on a heat demand, the main fuel valve 2 is opened but this will produce no result as the burner safety valve 8 is still closed. If upon properly operating electric supply source the heat source is to be operated, then the control handle 26 is actuated so that the normally open switch 27 is closed. As a result, the burner safety valve 8 is opened manually and upon current flow in the electromagnet 23 the armature 24 is attracted to the electromagnet 23 of the burner safety device. Gas or oil is now supplied by the fuel conduit 6 to the main valve 2 and to the two pilot fuel valves 13 and 17, which are connected in parallel. The electric supply voltage is now applied via line 19 and the changeover switch 5 to line 28 so that the relay coils 31 and 33 are energized and the associated switches are actuated. As a result, the supply voltage is applied via line 36 and changeover switch 44 to line 45 to energize the thermoelectric current simulator 46, which now applies a simulated thermoelectric voltage via lines 47 and 48 to line 21 and 22 so that the electromagnet 23 attracts the armature 24. When the control handle 26 is now released, the switch 27 remains closed and the burner safety valve 8 remains open. The heat source is now ready for operation. If the heat demanding sensor switch device 4 is actuated based on a heat demand, the main fuel valve 2 is opened and the changeover switch 5 is actuated so that the supply voltage is applied to line 29. As a result, the solenoid coil 14 is energized and the pilot fuel valve 13 is opened so that fuel is supplied to the pilot burner 12. As no voltage is now applied to the line 28, the relay coil 31 is now de-energized so that the changeover switch 44 and the normally open contact 38 move to their normal positions without a delay whereas the normally open switch 35 of the relay 34 is released with a delay. Until the switch 35 is released, the supply voltage is applied via line 29, 37 and 39 to the ignition transformer 40 so that the fuel emerging from the pilot burner 12 is ignited at the igniting electrode 42. When the fuel has been ignited, the thermocouple 20 is heated and begins to energize the electromagnet 23, which has been de-energized when the slow-releasing relay 34 has released its switch 35 so that the supply voltage is no longer applied via line 45 to the thermoelectric current simulator 46. If the pilot burner 12 fails to be ignited, then burner safety valve 8 closes after the delayed switching of the relay 34.

From the foregoing description it is apparent that the main burner 1 and the pilot burner 12 either burn or are extinguished at the same time depending on the condition of the heat source. When the heat demand signal is terminated, the changeover switch 5 is actuated to re-energize the two relay coils 31 and 33 so that the pilot fuel valve 13 is closed and the thermocouple 20 ceases to deliver current when the thermocouple 20 has cooled down. Simulated thermoelectric voltage is now applied based on the settings of switches 35 and 44.

A failure of the electric supply voltage will have the following results, depending on the condition of the heat source:

A failure of the electric supply voltage during the operation of the heat source will cause pilot burner 12 to extinguish because the associated solenoid valve 13 is closed. The main burner continues to burn and the heat source is monitored by the burner safety valve 8, to which thermoelectric current is applied by the thermocouple 20 in response to the operation of the main burner. When the electric supply voltage is again available, the solenoid 13 for the pilot fuel is re-opened and the pilot burner burns again. In case of a failure of the electric supply voltage when the heat source is ready for operation, the two relays 32 and 34 are de-energized so that the delivery of simulated thermoelectric current is discontinued. As a result, the electromagnet 23 is de-energized so that the burner safety valve 8 closes. This has no further results as the heat source had not been operating. But the heat source cannot be started now in response to a heat demand signal. The user will notice this situation after some time either because the open circuit water heater does not supply hot water on demand or because the flow temperature of the heating system decreases below a preset lower limit. In both cases, fuel will be supplied to the pilot burner if the control handles 16 and 26 are actuated at the same time. The fuel emerging from the pilot burner 12 can be ignited by hand and the thermoelectric burner safety device will be operating as the thermocouple is heated. In response to a heat demand signal, the main fuel valve 2 will be strictly mechanically opened. The heat source and the burner safety device will now be monitored by the thermocouple. When the heat demand signal is terminated, the main valve 2 is closed and the heat source is now ready for operation as the pilot burner is burning and is monitored by the thermocouple. A reappearance of the electric supply voltage will not change the condition of the circuit as the actuation of the control handle 16 has opened the switch 18. When the supply voltage has re-appeared, the switch 18 may be closed so that the valve 17 is closed, too. When no heat demand signal is then delivered by the heat demanding sensor switch device 4, the thermoelectric voltage is simulated as described hereinbefore because the thermocouple takes some time to cool down when the pilot burner 12 has extinguished. The burner safety valve 8 remains closed during that time. But if the control handle 16 is returned when a heat demand signal is delivered, then the solenoid valve 13 will open immediately so that the operation of the pilot burner 12 will be continued except for a very short interruption interval and will ignite the main burner 1 as described hereinbefore.

Figure 2:
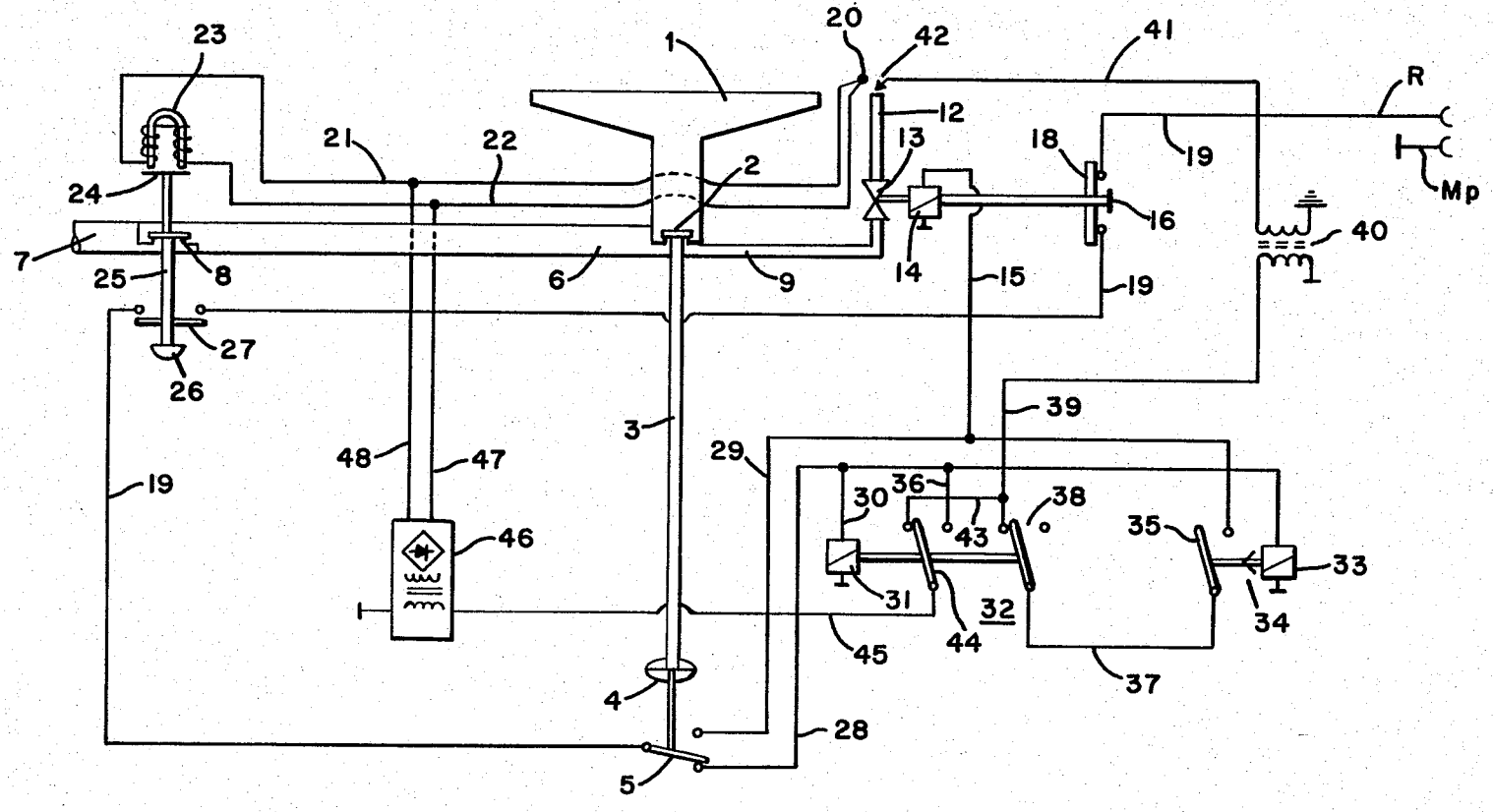
FIG. 2 is a view of a schematic diagram showing a modified ignition and monitoring provision.

In the modified arrangement as shown in FIG. 2, the pilot fuel conduit 9 is not branched and the control handle 16 directly controls the valve member of the solenoid valve 13 controlling the pilot fuel. Actuation of the handle 16 effects locking of the pilot feed valve 13 in its open position so that the same result is obtained as in the context of the embodiment shown in FIG. 1.

The arrangement shown in FIG. 2 is less expensive because the branching of the conduits for the pilot fuel and the hand-operated valve 17 are eliminated.

All elements illustrated in FIG. 2 are shown in a state without electrical current flow. The only precondition is that line voltage is applied to the two terminals on the left side. The contact 18 is closed in rest position, however the assumption regarding FIG. 2 is that the power was lost. In order to eliminate the line voltage returning at an unsuitable point in time, the contact 18 is opened by actuating the handle 16, which opens at the same time the pilot gas valve 13. The electric solenoid is without concern at this point. The pilot gas valve 13 is kept in the open position and thus the contact 18 remains open. The flow of gas to the pilot gas valve and to the main burner is blocked, since the ignition safety valve 8 is still closed. In order to achieve operational status the ignition safety valve has to be pressed or actuated, where the first valve disposed in the gas line has to be opened and the armature 24 is placed at the electromagnet 23. This frees the gas stream. The pilot gas flows out at the pilot burner 12 and since the electrical ignition is at this point inoperable, the pilot has to be ignited with a match. The ignited pilot burner gas heats the thermoelement, which feeds power to the electromagnet such that after a certain time the ignition safety valve is kept open via the thermoelectric circuit. If the tapping cock is now opened, then the water flow switch 4 opens the valve in the main path of the gas such that the main burner can be ignited via the pilot burner and starts to burn. If the simulation voltage returns in this state, then this is without effect because of the open contact 18. A closure of the tapping cock effects a closing of the gas valve to the main burner, the pilot burner continues to burn, the ignition safety valve remains open, since the pilot burner further heats the thermoelectric element. A renewed provision of gas via the tapping cock causes a renewed starting of the main burner. A resetting of the handle 16 is required for terminating operation of the apparatus, whereby the contact 18 is closed and at the same time the pilot gas magnetic solenoid 14 is closed. Alternatively, the ignition safety solenoid valve could be ripped off the armature of the thermo-electric safety provision in order to extinguish the apparatus.

Alternatively, automatic operation can be performed by the apparatus of FIG. 2. A precondition is the presence of a line voltage at the line 19. Thus the line voltage is applied via line 19 to the contact 27 of the ignition safety valve 8, which has to be pressed in manually. This closes the respective contact 27 such that the line voltage is present at the foot point of the changeover switch 5 associated with the water flow switch 4. This puts the relay 31 of the corresponding changeover switch under voltage in the circuit shown and the relay starts pulling in and switches the double contact. This places line voltage at the thermo current simulating unit 46 and a thermo-current is simulated for the solenoid 24 maintaining the valve 8 open. In addition the second relay 34 starts to attract and switches its contact 35. This prevents a flow of voltage to the electromagnet 14. This state remains as long until no tapping of water occurs. In case water is being taken, the changeover switch 5 associated with the water flow switch 4 is turned over. The switching of the contact of the water flow switch effects a falling of the double contact relay 32 and a dropping of the other relay 34. The latter dropping however occurs with a time delay such that the electric magnet 14 of the pilot valve 13 is excited during the delay time and at the same time the ignition transformer 40. Thus pilot gas flows out of the pilot burner 12 during this delay time and attempts of ignition occur. The pilot burner 12 heats the thermoelectric element 20 and a thermoelectric current builds up. If the thermoelectric current is present during the delay time, then the solenoid 23 is not any longer operated by the line voltage but instead by the thermoelectric current. If this sequence of steps does not occur, then the apparatus is switched off after passage of the delay time. The falling of the ignition safety valve 8 has the result that a new tapping process does not yield the desired result, but the apparatus is started again by pressing of the handle 26 of the ignition safety valve 27.

It is to be understood that each of the elements described above, or two or more together, may also find a useful application in other types of system configurations and in energy control procedures differing from the types described above.

While the invention has been illustrated and described in the context of a burner safety ignition and monitoring system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A burner safety ignition system for a fluid fuel using burner comprising a feed line for the fluid fuel;

a pilot feed valve for controlling the flow of fluid fuel to a pilot burner and piped to the feed line;

a pilot burner piped to the pilot feed valve;

a main burner valve for controlling the flow of fluid fuel to the main burner and piped to the feed line;

a main burner piped to the main burner valve;

an electric supply source;

an electric ignition system for the pilot burner connected to the electric supply source;

a second pilot feed valve located in a feed line bypass of said first pilot valve;

a handle member for manually operating said second pilot feed valve;

a switch actuated by the handle member for disconnecting the electrical supply source from the electric ignition system upon actuation of the handle member; and an electrical actuator supplied from the electrical supply source and including means for operating said first mentioned pilot feed valve responsive to combustion at said pilot or main burner.

2. The burner safety ignition system according to claim 1 wherein the electric ignition system comprises an ignition transformer connectable to the electric supply source.

3. The burner safety ignition system according to claim 2 wherein the electric ignition system comprises a thermoelectric current simulation member connected to the electric supply source.

4. The burner safety ignition system according to claim 3 further comprising means for locking the handle in a position corresponding to an open pilot feed valve.

5. The burner safety ignition system according to claim 3 further comprising a normally open contact of a thermoelectric safety relay and a changeover switch actuated by a thermal sensor switch and the normally open contact and the changeover switch are disposed in series with the switch actuated by the handle member.

6. The burner safety ignition system according to claim 3 further comprising an ignition device for igniting the burner and/or pilot;

a time delay member connected to the ignition device;

a changeover switch disposed in series with the switch actuated by the handle member and connected via one line to the time delay member and to the electrically operated pilot feed valve.

7. The burner safety ignition system according to claim 6 further comprising a second line connection of the changeover switch connected to the time delay member and to a second changeover switch, which is connected via a line to a thermoelectric current simulation member.

8. The burner safety ignition system according to claim 7 wherein the second changeover switch follows to a switch of the time delay member, and the second changeover switch connects in one position the thermoelectric current simulation member and in the other position the ignition device to the electric supply voltage.

9. A burner safety ignition system for a fluid fuel using burner comprising a feed line for the fluid fuel;

a pilot feed valve for controlling the flow of fluid fuel to a pilot burner and piped to the feed line;

a handle member for manually operating said pilot feed valve;

a pilot burner piped to the pilot feed valve;

a main burner valve for controlling the flow of fluid fuel to the main burner and piped to the feed line;

a main burner piped to the main burner valve;

an electric supply source;

an electric ignition system for the pilot burner connected to the electric supply source;

a switch actuated by the handle member for disconnecting the electrical supply source from the electric ignition system upon actuation of the handle member; and an electrical actuator supplied from the electrical supply source and including means for operating said pilot feed valve responsive to combustion at said pilot or main burner.

10. The burner safety ignition system according to claim 9 wherein the electric ignition system comprises an ignition transformer connectable to the electric supply source.

11. The burner safety ignition system according to claim 10 wherein the electric ignition system comprises a thermoelectric current simulation member connected to the electric supply source.

12. The burner safety ignition system according to claim 11 further comprising means for locking the handle in a position corresponding to an open pilot feed valve.

13. The burner safety ignition system according to claim 11 further comprising a normally open contact of a thermoelectric safety relay and a changeover switch actuated by a thermal sensor switch and the normally open contact and the changeover switch are disposed in series with the switch actuated by the handle member.

14. The burner safety ignition system according to claim 11 further comprising an ignition device for igniting the burner and/or pilot;

a time delay member connected to the ignition device;

a changeover switch disposed in series with the switch actuated by the handle member and connected via one line indirectly to the time delay member and directly to the electrically operated pilot feed valve.

15. The burner safety ignition system according to claim 14 further comprising a second line connection of the changeover switch connected to the time delay member and to a second changeover switch, which is connected via a line to a thermoelectric current simulation member.

16. The burner safety ignition system according to claim 15 wherein the second changeover switch follows to a switch of the time delay member, and the second changeover switch connects in one position the thermoelectric current simulation member and in the other position the ignition device to the electric supply voltage.

17. A method for manually or electrically igniting a burner comprising feeding fluid fuel to a first pilot feed valve from a fuel source;

controlling the the flow of fluid fuel to a pilot burner by actuating the first pilot feed valve;

feeding fluid fuel from the first pilot feed valve to the pilot burner;

feeding fluid fuel from a fuel source to a main burner valve;

controlling the flow of fluid fuel to a main burner by actuating the main burner valve;

feeding the fuel from the main burner valve to the main burner;

energizing an electric ignition system for the pilot burner with electric power;

at times electrically actuating said first pilot feed valve responsive to combustion at said pilot or main burner;

at other times manually actuating a second pilot feed valve located in a feed-line bypass of said first pilot feed valve by way of a handle member; and disconnecting the electric supply source from the electric burner ignition system upon manual actuation of the second pilot feed valve.

18. The method for manually or electrically igniting a burner according to claim 17 further comprising simulating a thermoelectric current to an ignition safety valve.

19. The method for manually or electrically igniting a burner according to claim 17 further comprising locking the handle member in a position corresponding to an open pilot feed valve.

20. The method for manually or electrically igniting a burner according to claim 17 further comprising actuating by way of a thermal demand sensor a changeover switch disposed in series with a contact of the pilot feed valve and the work contact of a normally open thermoelectric safety feed valve.

21. The method for manually or electrically igniting a burner according to claim 17 further comprising connecting a contact of a changeover switch with one line, which runs to the first pilot feed valve provided as well as via a time delay member to an ignition device.

22. The method for manually or electrically igniting a burner according to claim 21 further comprising connecting the other contact of the changeover switch to a line which runs to the time delay member as well as to a second changeover switch, which is connected via a line to a thermoelectric current simulation member.

23. The method for manually or electrically igniting a burner according to claim 22 wherein a switch of the time delay member is followed by a second changeover switch, which connects in one position a thermoelectric current simulation member to an electric supply voltage and in the other position connects the ignition device to the electric supply voltage.

24. A method for manually or electrically igniting a burner comprising feeding fluid fuel to a pilot feed valve from a fuel source;

controlling the the flow of fluid fuel to a pilot burner by manually actuating a handle member of the pilot feed valve;

feeding fluid fuel from the pilot feed valve to the pilot burner;

feeding fluid fuel from a fuel source to a main burner valve;

controlling the flow of fluid fuel to a main burner by actuating the main burner valve;

feeding the fuel from the main burner valve to the main burner;

energizing an electric ignition system for the pilot burner with electric power;

at times electrically actuating a burner safety valve controlling fuel to both the pilot burner and main burner by means of a thermoelectric element generating a current in response to combustion at said pilot or main burner;

disconnecting the electric supply source from the electric burner ignition system upon manual actuation of the pilot feed valve.

25. The method for manually or electrically igniting a burner according to claim 24 further comprising locking the handle member in a position corresponding to an open position of the pilot feed valve.

26. The method for manually or electrically igniting a burner according to claim 24 further comprising actuating by way of a thermal demand sensor a changeover switch disposed in series with an electrical contact of the pilot feed valve and a work contact of said burner safety valve.

27. The method for manually or electrically igniting a burner according to claim 24 further comprising connecting a contact of a changeover switch with one line, which runs to the pilot feed valve provided as well as via a time delay member to an ignition device.

28. The method for manually or electrically igniting a burner according to claim 27 further comprising connecting another contact of the changeover switch to a line which runs to the time delay member as well as to a second changeover switch, which is connected via a line to said means simulating a thermoelectric current.

29. The method for manually or electrically igniting a burner according to claim 28 wherein the second changeover switch connects in one position the thermoelectric current simulation means to an electric supply voltage and in another position connects an ignition device to the electric supply voltage.

* * * * *

UNITED STATES PATENT AND TRADEMARK OFFICE

CERTIFICATE OF CORRECTION

PATENT NO. : 4,529,373

DATED : July 16, 1985

INVENTOR(S) : Ulrich Ortlinghaus

It is certified that error appears in the above-identified patent and that said Letters Patent are hereby corrected as shown below:

Title page, insert in column 1:

Related U.S. Application Data

(63) Continuation-in0part of Ser. No. PCT/DE81/00 224, Filed Dec. 12, 1981

Foreign Application Priority Data

(30) Dec. 16, 1980 (DE) Fed. Republic of Germnay 8033446

Signed and Sealed this

*Twenty-second* Day of *October 1985*

[SEAL]

*Attest:*

DONALD J. QUIGG

*Attesting Officer*

*Commissioner of Patents and Trademarks—Designate*